United States Patent [19]

Hatanaka et al.

[11] 4,063,147

[45] Dec. 13, 1977

[54] STABILIZED POWER SUPPLY CIRCUIT

[75] Inventors: Hiroshi Hatanaka, Sagamihara; Kiyosuke Suzuki, Kitamoto, both of Japan

[73] Assignee: Sony Corporation, Tokyo, Japan

[21] Appl. No.: 676,911

[22] Filed: Apr. 14, 1976

[30] Foreign Application Priority Data

Apr. 16, 1975 Japan ..... 50-51735

[51] Int. Cl.[2] ..... G05F 1/56; G05F 3/14

[52] U.S. Cl. ..... 323/22 Z; 307/15; 307/35; 307/318

[58] Field of Search ..... 323/22 Z, 22 T; 307/11, 307/12, 15, 31–33, 35, 296, 297, 318

[56] References Cited

U.S. PATENT DOCUMENTS

| | | | |
|---|---|---|---|
| 3,577,062 | 5/1971 | Hoffman | 323/22 Z |
| 3,881,150 | 4/1975 | Gay | 323/22 Z |

FOREIGN PATENT DOCUMENTS

| | | | |
|---|---|---|---|
| 1,189,183 | 3/1965 | Germany | 323/22 Z |
| 1,563,866 | 8/1970 | Germany | 307/318 |
| 23,306 | 3/1971 | Japan | 323/22 Z |

*Primary Examiner*—Gerald Goldberg
*Attorney, Agent, or Firm*—Lewis H. Eslinger; Alvin Sinderbrand

[57] ABSTRACT

A stabilized power supply circuit has a stabilized or regulator circuit connected between an input terminal and a first output terminal and a constant voltage element for example, a Zener whose one electrode is connected to the input terminal and whose other electrode is connected to the first output terminal, and a second output terminal is connected to the first-mentioned electrode of the constant voltage element.

3 Claims, 3 Drawing Figures

STABILIZED POWER SUPPLY CIRCUIT

BACKGROUND OF THE INVENTION

1. Field of the Invention

This invention relates generally to a stabilized power supply circuit, and is directed more particularly to a stabilized power supply circuit which produces two or more stabilized output voltages.

2. Description of the Prior Art

In general, in the case where two regulated voltages are required as power supply sources and it is necessary that both the voltages be stable in substantially the same degree, it is sufficient to provide two regulators. However, if one of the voltages is higher than the other but does not need to be as stable as the latter, it is preferable not to use two regulators in view of the cost thereof. In the latter case, the higher voltage may be produced by using a Zener diode only, while the other voltage is produced by an ordinary regulator. However, since the total power consumption by the regulator increases, this method is not so effective. Further, this method can not produce a very high voltage.

SUMMARY OF THE INVENTION

It is an object of this invention to provide a stabilized power supply circuit which produces a stable first output voltage and a second output voltage which is higher than the former in voltage but lower in stability.

It is another object of the invention to provide a stabilized power supply circuit which is small in power consumption and which can tolerate a wide range of variation of an input voltage.

According to an aspect of this invention there is provided a stabilized power supply circuit which comprises an input terminal for receiving a DC voltage, a first output terminal for supplying a first stabilized output voltage, regulator circuit connected between the input terminal and a first output terminal, the regulator circuit having a transistor and a first Zener diode, a second output terminal, a second Zener diode connected between the first and second output terminals; and a resistor connected between the input terminal and the second output terminal.

The above, and other objects, features and advantages of the invention, will become apparent from the following description taken in conjunction with the accompanying drawings.

DESCRIPTION OF THE PREFERRED EMBODIMENT

In order to better understand this invention, prior art stabilized power supply circuits, which produce two output voltages and include a first stabilized power supply circuit of low output impedance and a second stabilized power supply circuit whose output impedance is relatively high but whose output voltage is higher than that from the first circuit, will first be described with reference to FIGS. 1 and 2.

Figure 1:
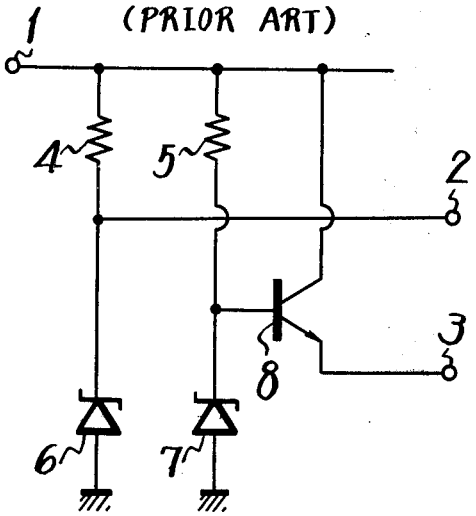
Fig. 1 (PRIOR ART)
FIGS. 1 and 2 are connection diagrams showing respective prior art power supply circuits producing two output voltages.

The prior art stabilized power supply circuit producing two output voltages shown in FIG. 1 consists of two separate stabilized power supply circuits.

In FIG. 1, reference numeral 1 designates an input terminal which is supplied with an input voltage. With the circuit of FIG. 1, a first output is obtained from a first output terminal 3 connected to the emitter of a transistor 8. Therefore, a load (not shown) is the emitter load of transistor 8. A Zener diode 7 is supplied with a bias current through a resistor 5. The Zener voltage produced across the Zener diode 7 is applied to the base electrode of the transistor 8 as a reference voltage. Thus, even when the voltage applied to the input terminal 1 is fluctuated, the load which will be connected to the emitter electrode of the transistor 8 can be driven with a constant voltage.

With the circuit of FIG. 1, a second output is obtained from a second output terminal 2. A Zener diode 6 is supplied with a bias current through a resistor 4 and the Zener voltage produced across the Zener diode 6 is applied to a load (not shown) connected to the second output terminal 2 to drive the same with a constant voltage.

With the power supply circuit shown in FIG. 1, since it is necessary to supply the bias currents to both of the Zener diodes 6 and 7, respectively, the power consumption in the power supply circuit itself increases.

Figure 2:
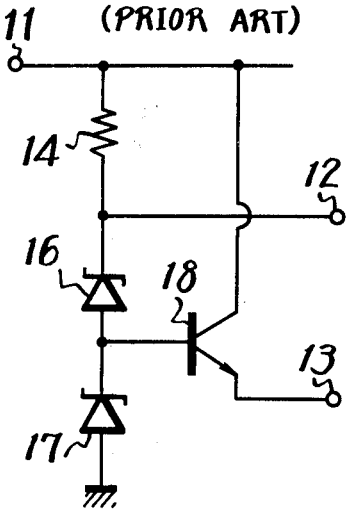
Fig. 2 (PRIOR ART)

In the prior art power supply circuit shown in FIG. 2, Zener diodes 16 and 17 are connected in series with each other and a common bias current is supplied to both the Zener diodes 16 and 17 through a resistor 14. With this prior art power supply circuit of FIG. 2, a first output is obtained at a first output terminal 13 connected to the emitter electrode of a transistor 18. The Zener voltage produced across the Zener diode 17 is supplied to the base electrode of the transistor 18 as a reference voltage. Thus, a load (not shown) which will be connected to the emitter electrode of the transistor 18 is driven with a constant voltage.

A second output voltage is obtained at a second output terminal 12, and a load (not shown) which will be connected to the output terminal 12 is driven with a constant voltage which is the sum of the Zener voltages produced across the Zener diodes 17 and 16.

With the prior art power supply circuit shown in FIG. 2, since the bias current supplied to the Zener diodes 16 and 17 is common, the power consumption of the power supply circuit itself is reduced as compared with the prior art power supply circuit shown in FIG. 1. However, with the power supply circuit of FIG. 2 when fluctuation of the input voltage applied to the input terminal 11 causes such input voltage to become smaller than the sum of the Zener voltages across the Zener diodes 16 and 17, no stabilized output voltage can be produced thereby.

An example of a stabilized power supply circuit according to this invention, which will produce two output voltages and is free from the above noted defects inherent to the prior art power supply circuits, will now be described with reference to FIG. 3.

Figure 3:
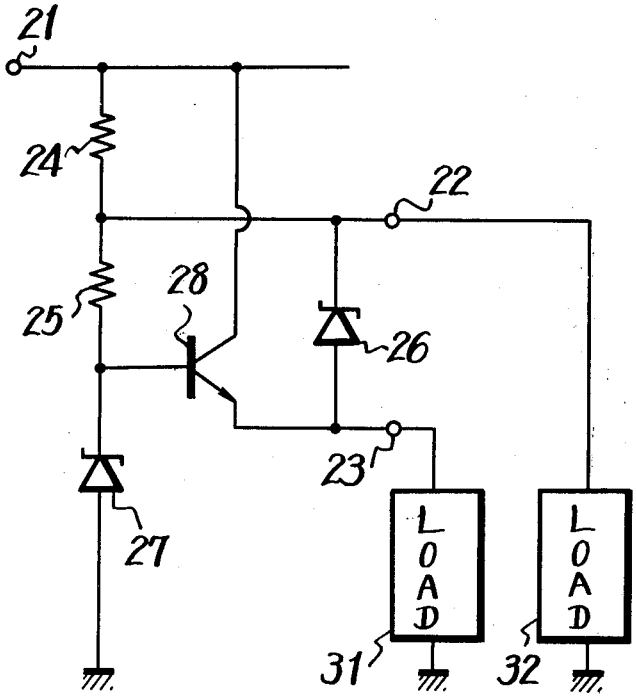
FIG. 3 is a connection diagram showing an embodiment of the stabilized power supply circuit according to this invention.

In FIG. 3, reference numeral 21 designates an input terminal to which is, for example, an input DC voltage is applied, and first and second stabilized output voltages are derived from first and second output terminals 23 and 22, respectively. A constant voltage element, such as a Zener diode 27, is supplied with a bias current from the input terminal 21 through a series connection of resistors 24 and 25 connected between the input terminal 21 and the Zener diode 27 and which serve as a bias resistor for the latter. A constant voltage element such as a Zener diode 26 is connected between the first output terminal 23 and the connection point of the resistors 24 and 25, so that the Zener diode 26 is supplied with a bias current from the input terminal 21 through the resistor 24, which also serves as the bias resistor for the Zener diode 26, and a load 31 is connected to the output terminal 23.

A transistor 28 of, for example, NPN-type, has its base electrode connected to the connection point between the Zener diode 27 and the resistor 25, while its collector electrode is connected to the input terminal 21, and its emitter electrode is connected to the first output terminal 23.

The resistors 24, 25, the Zener diode 27 and the transistor 28 form a regulator circuit the output voltage from which is delivered as the first output voltage to the first output terminal 23. While, a second stabilized output voltage is obtained at the second output terminal 22 led out from a connection point between the Zener diode 26 and the resistor 24. The second stabilized output voltage is supplied to a load 32 which is connected to the second output terminal 22.

In the illustrated example of the invention shown in FIG. 3, the regulator circuit includes only one transistor 18, but it is possible that the regulator circuit includes a plurality of transistors. Further, it is also possible that the Zener diode 27 is supplied with a bias current through only the resistor 25 and the Zener diode 26 is supplied with a bias current through the resistor 24.

In the power supply circuit of the invention shown in FIG. 3, the output terminal 23 has a low output impedance so that it is used in the case where a relatively large output current is required, while the output terminal 22 has a relatively high output impedance, so that it is used in the case where an output voltage higher than that at the output terminal 23 is required.

When the load 31 connected to the output terminal 31 becomes low and hence the voltage appearing at the output terminal 23 becomes high, the voltage across the base-emitter path of the transistor 28 becomes low, since the voltage across the Zener diode 27 is constant. As a result, the base current of the transistor 28 is reduced, so that its collector current (which is approximately equal to the current flowing out from the output terminal 23) is also reduced. For this reason, the output voltage at the output terminal 23 becomes low and hence is kept at the original value.

One end of the Zener diode 26 is connected to the stabilized output terminal 23 and the Zener diode 26 is in yield condition, so that the output terminal 22 connected to the other end of the Zener diode 26 can be kept at a constant voltage.

When the load 32 connected to the output terminal 22 becomes low and hence the voltage appearing at the output terminal 22 becomes high, the shunt current flowing from the input terminal 21 through the resistor 24 and the Zener diode 26 to the load 31 increases. As a result, the current flowing through the load 32 is reduced and hence the voltage at the output terminal 22 can be kept constant. In this case, even if the shunt current flowing through the load 31 increases and hence the voltage at the output terminal 23 is increased, the output terminal 23 is stabilized in the manner described above and, accordingly, the load 31 is not affected by the fluctuation of the load 32.

The above description of operation refers to the case where the loads 31 and 32 connected to the output terminals 23 and 22 are fluctuated. On the other hand, when the input voltage applied to the input terminal 21 is fluctuated, the respective voltages produced across the Zener diodes 26 and 27 (Zener voltages) are constant. Further, due to the fact that it is characteristic of a transistor that its collector current is not so affected by the voltage across its emitter-collector path but rather is determined by its base current, the operation of the previously described operation of transistor 28 is not affected by fluctuation of the input voltage. Accordingly, in the case that the input voltage to the input terminal 21 is fluctuated, the power supply circuit of the invention is not affected by the fluctuation of the input voltage and produces stabilized output voltages at its output terminals 22 and 23, respectively.

Further, even in the case where the input voltage is so reduced as to become lower than the sum of the Zener voltages across the Zener diodes 26 and 27, if the input voltage is higher than the break-down voltage of Zener diode 27, a stabilized output voltage is obtained at the output terminal 23, and an output voltage stabilized by the Zener diode 27 can be also obtained at the output terminal 22.

In the illustrated example of the invention shown in FIG. 3, two output terminals are provided, but it may be possible to provide three or more output terminals. By way of example, if three output terminals are desired to be provided in the example of FIG. 3, it is sufficient that one end of a third Zener diode is connected to the connection point between the input terminal 21 and the resistor 24, the other end of the third Zener diode is connected to the output terminal 22, and a third output terminal is led out from the first-mentioned end of the third Zener diode. In this case it may be necessary to insert a bias resistor between the input terminal 21 and the third Zener diode.

With the power supply circuit of the present invention described above, the bias currents flowing through the constant voltage elements are utilized as the output currents, so that the consumed current can be relatively reduced. Further, since the constant voltage elements are connected between the input and output terminals of the stabilized power supply circuit, the lower limit of the allowable fluctuation range of the input voltage can be easily determined.

In the illustrated example of the invention shown in FIG. 3, an NPN-type transistor is used as the transistor 28, however, a PNP-type transistor can be, of course, used as the transistor 28.

Further, although the illustrated regulator circuit has the transistor connected in series between the input and output terminals thereof, it is also possible to incorporate the invention in a regulator circuit in which the transistor is connected to shunt the output voltage.

Although a single preferred embodiment of the present invention is described above with reference to the drawing, it will be apparent that many modifications and variations could be effected by one skilled in the art without departing from the spirit or scope of the novel concepts of the invention. Therefore, the scope of the invention should be determined by the appended claims.

We claim as our invention:

1. A stabilized power supply circuit, comprising:
   a. an input terminal for receiving a DC voltage;
   b. a first output terminal for supplying a first stabilized output voltage;

c. a regulator circuit connected between said input terminal and said first output terminal, said regulator circuit having a transistor with emitter and collector electrodes connected between said input terminal and said first output terminal, and a first Zener diode;

d. a second output terminal;

e. a second Zener diode connected between said first and second output terminals; and f. a resistor connected between said input terminal and said second output terminal.

2. A stabilized power supply circuit as claimed in claim 1, wherein the base electrode of said transistor is connected with said first Zener diode.

3. A stabilized power supply circuit as claimed in claim 2, wherein the base electrode of said transistor is connected through a second resistor to said second output terminal.

* * * * *